US005119344A

United States Patent [19]

Innes

[11] Patent Number: 5,119,344

[45] Date of Patent: Jun. 2, 1992

[54] DOWNHOLE TOOL

[75] Inventor: Frank A. S. Innes, Aberdeen, Scotland

[73] Assignee: Halliburton Logging Services, Inc., Houston, Tex.

[21] Appl. No.: 673,542

[22] Filed: Mar. 22, 1991

[30] Foreign Application Priority Data

Jan. 24, 1991 [GB] United Kingdom ..... 9101576

[51] Int. Cl.[5] ..... G01V 1/40

[52] U.S. Cl. ..... 367/84

[58] Field of Search ..... 367/83, 84

[56] References Cited

U.S. PATENT DOCUMENTS

| | | | |
|---|---|---|---|
| Re. 30,055 | 7/1979 | Claycomb | 367/84 |
| 4,785,300 | 11/1988 | Chin et al. | 367/84 |
| 4,847,815 | 7/1989 | Malone | 367/84 |
| 4,914,637 | 4/1990 | Goodsman | 367/84 |
| 4,956,823 | 9/1990 | Russell et al. | 367/84 |

*Primary Examiner*—Ian J. Lobo

*Attorney, Agent, or Firm*—William J. Beard

[57] ABSTRACT

A downhole MWD tool for generating pressure pulses in a drilling fluid comprises an elongate body for positioning in a drill collar and a plurality of blades spaced around the body. Each blade is divided into an independent front section and rear section one of the front and rear sections being mounted on a rotatable shaft such that the front and rear sections are angularly displaceable relative to one another between a first position in which the sections are aligned and a second position in which the rear blades obstruct fluid flow between the front sections to generate a pressure pulse. A hydraulic actuator is operable to rotate the shaft, and is powered by the pressure difference in the drilling fluid between an upstream end of the tool and a position downstream of the tool.

8 Claims, 1 Drawing Sheet

DOWNHOLE TOOL

The invention relates to a device such as a well-logging tool, and more particularly to a tool of the measure-while-drilling (MWD) type.

When oil wells or other boreholes are being drilled it is frequently necessary to determine the orientation of the drilling tool so that it can be steered in the correct direction. Additionally, information may be required concerning the nature of the strata being drilled, the temperature or the pressure at the base of the borehole, for example. There is thus a need for measurements of drilling parameters, taken at the base of the borehole, to be transmitted to the surface.

One method of obtaining at the surface the data taken at the base of the borehole is to withdraw the drill string from the hole, and to lower the instrumentation including an electronic memory system down to the base.

The relevant information is encoded in the memory to be read when the instrumentation is raised to the surface. The disadvantages of this method are the considerable time, effort and expense involved in withdrawing and replacing the drill string. Furthermore, updated information on the drilling parameters is not available while drilling is in progress.

A much-favoured alternative is to use a measure-while-drilling tool, wherein sensors or transducers positioned at the lower end of the drill string continuously or intermittently monitor predetermined drilling parameters and the tool transmits the appropriate information to a surface detector while drilling is in progress. Typically, such MWD tools are positioned in one of the cylindrical drill collars close to the drill bit, and use a system of telemetry in which the information is transmitted to the surface detector in the form of pressure pulses through the drilling mud or fluid which is circulated under pressure through the drill string during drilling operations. Digital information is transmitted by suitably timing the pressure pulses. The information is received and decoded by a pressure transducer and computer at the surface.

The drilling mud or fluid is used to cool the drill bit, to carry chippings from the base of the bore to the surface and to balance the pressure in the rock formations. Drilling fluid is pumped at high pressure down the centre of the drill pipe and through nozzles in the drill bit. It returns to the surface via the annulus between the exterior of the drill pipe and the wall of the borehole.

In a number of known MWD tools, a negative pressure pulse is created in the fluid by temporarily opening a valve in the drill collar to partially bypass the flow through the bit, the open valve allowing direct communication between the high pressure fluid inside the drill string and the fluid at lower pressure returning to the surface via the exterior of the string. However, the high pressure fluid causes serious wear on the valve, and pulse rates of only up to about 1 pulse per second can be achieved by this method.

Alternatively, a positive pressure pulse can be created by temporarily restricting the flow through the downpath within the drill string by partially blocking the downpath.

EP-A-0325047 (Russell et al) describes a measure-while-drilling tool employing a turbine with impeller blades, wherein the impeller rotates continuously under the action of the high pressure downward flow. Each impeller blade is split into two portions in a plane normal to the axis of rotation of the impeller. An electric generator is driven by the impeller assembly and the two portions of impeller blade are angularly displaceable relative to one another about the axis of rotation in response to a change in the load of the generator. When the two portions of the impeller blade are out of normal alignment, they provide increased resistance to the flow of the drilling fluid, so that as the angular displacement of the two portions varies, so will the pressure drop across the impeller assembly. The restoring force for returning the two portions of the impeller blades to normal alignment is provided by a spring or an elastomeric seal: if the restoring force is too weak a large pressure pulse can be developed, but there is a long delay before the portions are realigned so that the pressure pulse rate can only be very low. If the restraining force is too great the pulse rate can be sufficiently rapid for efficient data transmission, but the pressure pulses will be much weaker. Furthermore, the blades cannot be retained in the nonaligned position for long as there will be a natural tendency for the blade portions to realign.

US-A-4914637 (Positec Drilling Controls Ltd) discloses a number of embodiments of MWD tool having a pressure modulator for generating positive pressure pulses. The tool has a number of blades equally spaced about a central body, the blades being split in a plane normal to the longitudinal axis of the body to provide a set of stationary half-blades and a set of rotary half-blades. A temporary restriction in the fluid flow is caused by allowing the rotary half-blades to rotate through a limited angle, so that they are out of alignment with the stationary half-blades, the rotation being controlled by a solenoid-actuated latching means. In one embodiment, the drilling fluid is directed through angled vanes in front of the split blades in order to impart continuous torque to the rotary half-blades, such that the rotary half-blades rotate through a predetermined angle each time the latch is released, thus being rotated successively into and out of alignment with the stationary half-blades.

According to the present invention there is provided a downhole tool for generating pressure pulses in a drilling fluid, the tool comprising an elongate body for positioning in a drill collar of a drill string; a plurality of blades spaced around said body, each blade being divided into an independent front section and rear section, one of said front and rear sections being mounted on a rotatable shaft such that said front and rear sections are angularly displaceable relative to one another between a first position in which the sections are aligned and a second position in which the rear blades obstruct the fluid flow between the front sections to generate a pressure pulse; and hydraulic actuator means operable to rotate the rotatable shaft, the actuator means being powered by the pressure difference in the drilling fluid between an upstream end of the tool and a position downstream of the blades.

The blades are preferably positioned on the exterior of the body and in the preferred embodiment the front blade sections are mounted on the rotatable shaft. Each rear blade section preferably has a generally planar forward end surface extending generally normal to the direction of fluid flow.

In a preferred embodiment the hydraulic actuator has at least two chambers separated by a vane, the vane being mounted on the rotatable shaft. Each chamber has an inlet for high pressure fluid and an outlet for low pressure fluid.

In a particularly preferred embodiment the hydraulic actuator has a cylindrical housing extending coaxially around a section of the rotatable shaft. Two vanes extend from the section of shaft within the housing and two lobes extend from the interior of the housing, so that four separate chambers are formed within the actuator each having a high pressure inlet and a low pressure outlet. Means are provided for selectively alternately opening and closing the inlets and outlets in order to move the vanes under the influence of the pressure difference such that the shaft rotates alternately clockwise and anticlockwise through a limited angular displacement.

The means for opening and closing the inlets and outlets may be provided by a rotary valve which may be electrically operated by such means as a rotary solenoid.

An embodiment of the invention will now be described in greater detail by way of example with reference to the accompanying drawings, in which.

Figure 1:
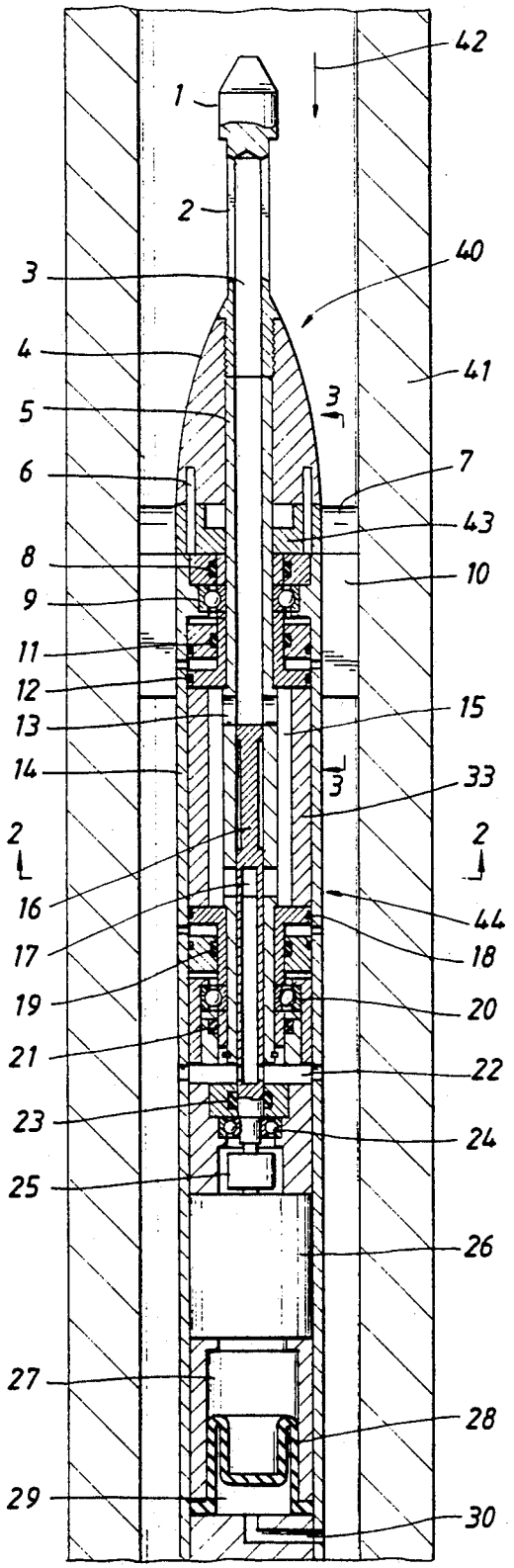
FIG. 1 is a longitudinal cross-section of a downhole tool for generating pressure pulses in a drilling fluid.

Referring first to FIG. 1, a downhole tool generally indicated by reference numeral 40 fits within a drill collar 41 of a drill string. The tool has a streamlined fairing or casing 4 facing into the downward flow of drilling fluid 50, and a standard fishing end 1 extends from the end of the fairing and permits the tool to be manipulated or to be retrieved should the tool need to be brought to the surface. The direction of flow of the drilling fluid within the drill collar is generally indicated by arrow 42. The tool has a hollow rotatable shaft 5, and mounted rigidly on the shaft is a collar 43 supporting front blade section 7. The collar 43 is fixed to the streamlined fairing 4 by means of drive pins 6.

A tool housing 14 is supported coaxially around the shaft 5, and bearings 9 at the upstream end of the housing and additional bearings 20 downstream therefore, permit the shaft to rotate within the housing. Since the tool operates in a hostile environment of high speed, high pressure abrasive fluid, bearings 9 are protected by seals 8 and 11, and bearings 20 are protected by seals 19 and 21 from the drilling fluid to reduce wear, and both bearings 9 and 20 are oil lubricated. One seal 11, 19 at each bearing can move longitudinally to equalise hydrostatic pressure.

Figure 3:
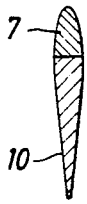
FIG. 3 shows the blade sections in a streamlined configuration.
Figure 4:
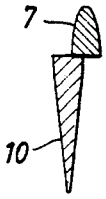
FIG. 4 shows the blade sections in a displaced configuration.

Rear blade sections 10 are mounted on the tool housing downstream from and immediately adjacent to the front blade section 7 on collar 43. Each front blade section 7 can be aligned with a rear blade section 10 to form a streamlined blade lying substantially parallel with the direction of flow of the drilling fluid. The streamlined shape of each aligned blade is illustrated in FIG. 3. Effectively, the front and rear blade sections form a set of blades equally spaced about a central shaft, the blades being split in a plane normal to the axis of rotation of the shaft. When the front and rear sections of the blades are aligned, the drag coefficient is very low (about 0.05) and the drilling fluid passes between the blades with little resistance. However, the front blade sections can be rotated out of line with the fixed rear blade sections as shown in FIG. 4. This greatly increases the drag coefficient (to about 0.5) since the flat front surfaces of the rear blade sections are presented to the fluid flow and thus a high back pressure is produced, allowing a pressure pulse to be transmitted through the drilling fluid.

The shaft 5 is rotated by an actuator indicated generally by reference numeral 44. The actuator is powered by the pressure difference in the drilling fluid between the front of the tool and the rear of the blades. According to Bernoulli's theorem, the pressure at any point in a fluid passing through a duct of varying cross-sectional area is inversely proportional to the square of the velocity at that point. The pressure is therefore higher at the front of the tool, upstream of the blades where the area of the duct is larger; and the velocity is lower, and the pressure is lower at a point downstream of the blades where the tool is wider, the area of the duct correspondingly smaller, and the velocity of the fluid correspondingly higher.

Figure 2:
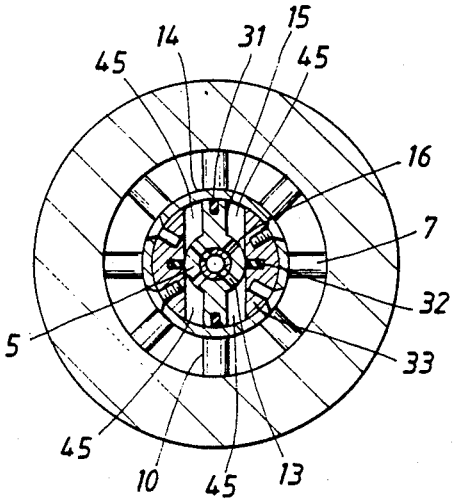
FIG. 2 is a somewhat schematic axial cross-sectional view of a hydraulic actuator according to a preferred embodiment of the invention.

Referring also to FIG. 2, the actuator 44 comprises two longitudinal vanes 15 at 180 degrees to each other. These longitudinal vanes are mounted on the rotatable shaft 5. The vanes are separated by two internal lobes 33 attached to the interior of the housing 14. Four chambers 45 are thus formed between the vanes and the lobes. Spring loaded seals 31 and 32 on the vanes and the lobes respectively prevent leakage of fluid between the chambers 45. It can be seen from FIG. 2 that if fluid under high pressure is admitted to two diametrically opposed chambers, and fluid under lower pressure is allowed to exhaust from the other two chambers, the vanes will rotate towards the area of lower pressure. Reversing the pressure difference will reverse the direction of rotation of the vanes, and hence the direction of rotation of the shaft 5 and the front blade sections 7.

Thus, each chamber 45 is provided with a high pressure inlet port 13 and a low pressure exhaust or outlet port 17. The flow of fluid through the inlet and outlet ports is controlled by an electrically operated rotary valve 16. High pressure fluid from upstream of the tool enters a fluid inlet 3 in the front of the streamlined fairing 4 via slots 2 in the upstream fishing end 1. The slots 2 act as a coarse filter for preventing large particles from entering the tool with the drilling fluid as these could damage the tool and inhibit the smooth operation of the actuator. The high pressure fluid passes through the centre of the shaft 5 and into a diametrically opposed pair of the inlet ports 13. The other pair of inlet ports remain closed, while the two chambers having open inlet ports should have their low pressure outlet ports closed, and the two chambers which have closed inlet ports should have their low pressure outlet ports open. Thus, the vanes will rotate through the limited angular displacement in one direction to exhaust the low pressure chambers. In order to reverse the direction of rotation of the vanes, those ports which were open should be closed, and those which were closed should be opened. The vanes and hence the front blade sections 7 thus rotate through a limited angular displacement and back again, alternating between the streamlined position of the blades shown in FIG. 3 and the out-of-line position of the blades shown in FIG. 4.

The rotary valve 16 is operated by an electric actuator 26 which can be a rotary solenoid or any other device capable of giving repeatable limited angular movement. The rear of the rotary valve 16 is carried in a rotary bearing 24 protected by a seal 23, and is linked by a coupling 25 to the electric actuator 26. O-rings are provided at 12 and 18 to seal the tool against penetration by drilling fluid.

Fluid outlets 22 are provided in the rotary valve 16 and housing 14 downstream of the tool to allow for the through-flow of the high pressure fluid which is not utilised in operating the actuator 44.

The electric actuator 26 is housed in a chamber filled with oil. To balance the high hydrostatic pressure in the borehole, a diaphragm 28 supported in housing 14 separates the oil 27 from the drilling fluid, but keeps the oil at the same pressure as the drilling fluid, which is admitted to a chamber 29 on the other side of the diaphragm to the oil via a small opening 30 in the housing 14. Any other suitable means can be used to achieve a pressure balance.

Pressure pulses within the drilling fluid can thus be produced at a rate of up to 10 pulses per second. A useful pulse rate is about 4 to 5 pulses per second, effectively generating a square wave of varying pressure in the fluid which can be detected at the surface by a pressure transducer which can detect, for example, a change of 40 to 50 psi in 3000 psi (270 to 350 kPa to 20. 7MPa).

I claim:

1. A downhole tool for generating pressure pulses in a drilling fluid, the tool comprising: an elongate body for positioning in a drill collar of a drill string; a rotatable shaft; a plurality of blades spaced around said body, each blade being divided into an independent front section and rear section, one of said front and rear sections being mounted on said rotatable shaft each that said front and rear sections are angularly displaceable relative to one another between a front position in which the sections are aligned and a second position in which the rear blades obstruct the fluid flow between the front sections to generate a pressure pulse; and hydraulic actuator means comprising a cylindrical housing extending coaxially around a section of said rotatable shaft; a pair of vanes extending from the second shaft within the housing such that four separate chambers are formed within the actuator; each said chamber having a high pressure inlet and a low pressure outlet and means for selectively alternately opening and closing the inlets and outlet to move the vanes under the influence of the pressure difference in the drilling fluid between and upstream end of the tool and a position downstream of the blades such that the shaft rotates alternately clockwise and anticlockwise through a limited angular displacement.

2. A tool according to claim 1, wherein the blades are positioned on the exterior of said body.

3. A tool according to claim 2, wherein said front blade sections are mounted on the rotatable shaft.

4. A tool according to claim 1, wherein each said rear blade section has a generally planar forward end surface extending generally normal to the direction of the fluid flow.

5. A tool according to claim 1, wherein said hydraulic actuator has at least two chambers separated by a vane, the vane being mounted on said rotatable shaft, and each said chamber having an inlet for high pressure fluid and an outlet for low pressure fluid.

6. A tool according to claim 1, wherein said means for opening and closing the inlets and outlets is an electrically operated rotary valve.

7. A tool according to claim 6, wherein said rotary valve is operated by a rotary solenoid.

8. A tool according to claim 1, wherein said four chambers are separated by means of biased seals.

* * * * *